US011480033B2

(12) United States Patent
Worm

(10) Patent No.: US 11,480,033 B2
(45) Date of Patent: Oct. 25, 2022

(54) WELL CASE BRUSHING AND SURGE BLOCKING APPARATUS

(71) Applicant: Emil Worm, Homeland, CA (US)

(72) Inventor: Emil Worm, Homeland, CA (US)

( * ) Notice: Subject to any disclaimer, the term of this patent is extended or adjusted under 35 U.S.C. 154(b) by 0 days.

(21) Appl. No.: 17/339,912

(22) Filed: Jun. 4, 2021

(65) Prior Publication Data

US 2021/0381343 A1 Dec. 9, 2021

Related U.S. Application Data

(60) Provisional application No. 63/034,828, filed on Jun. 4, 2020.

(51) Int. Cl.

| | |
|---|---|
| ***E21B 37/00*** | (2006.01) |
| ***F15B 20/00*** | (2006.01) |
| ***E21B 41/00*** | (2006.01) |
| ***F15B 15/20*** | (2006.01) |

(52) U.S. Cl.

CPC ..... *E21B 37/00* (2013.01); *E21B 41/00* (2013.01); *F15B 15/20* (2013.01); *F15B 20/00* (2013.01)

(58) Field of Classification Search

CPC ..... E21B 37/00; E21B 41/00; F15B 15/20; F15B 20/00

See application file for complete search history.

(56) References Cited

U.S. PATENT DOCUMENTS

| | | | | |
|---|---|---|---|---|
| 4,830,111 | A | 5/1989 | Jenkins | |
| 6,557,565 | B1 * | 5/2003 | McLin | E03B 3/15 166/173 |
| 8,205,676 | B2 | 6/2012 | Nelson | |

FOREIGN PATENT DOCUMENTS

| | | | |
|---|---|---|---|
| KR | 100979214 | B1 | 8/2010 |
| RU | 117535 | U1 | 6/2012 |
| RU | 128895 | U1 | 6/2013 |

* cited by examiner

*Primary Examiner* — James G Sayre

(57) ABSTRACT

A well case brushing and surge blocking apparatus includes a housing, a frame, an actuating arm, a gear assembly, a hydraulic motor, a hydraulic speed controller, and a hydraulic counterbalance. The housing is laterally connected to the frame. The gear assembly is laterally mounted to the frame and positioned opposite of the housing. The actuating arm is positioned within the housing as a stator of the hydraulic motor is externally mounted to the gear assembly, and a rotor of the hydraulic motor and the actuating arm is torsionally coupled with each other through the gear assembly. The hydraulic speed controller and the hydraulic counterbalance are mounted to the frame. The hydraulic motor is in fluid communication with the hydraulic speed controller and the hydraulic counterbalance so that a sand line of rig can be looped and operated through the well case brushing and surge blocking apparatus.

9 Claims, 10 Drawing Sheets

WELL CASE BRUSHING AND SURGE BLOCKING APPARATUS

The current application claims a priority to the U.S. Provisional Patent application Ser. No. 63/034,828 filed on Jun. 4, 2020.

FIELD OF THE INVENTION

The present invention generally relates to water well cleaning. More specifically, the present invention is a well case brushing and surge blocking apparatus that optimize the well cleaning method.

BACKGROUND OF THE INVENTION

In rural environments, much infrastructure that urban residents often take for granted does not exist. In particular, many smaller communities obtain drinking water solely from underground aquifers. As a result, in all rural environments, water wells are a necessity. Because of that, water well cleaning methods and devices are in demand as the water well cleaning process is a vital part to keep a water system sanitary, healthful, and in good condition. More specifically, the openings in a well casing provide passageways for the flow of water. Over time, the openings tend to become plugged with sand, the products of corrosion, sediment deposits, and other inorganic or organic complexes. As a result, these materials begin to cake and clog the openings in the well casing or screen thus reducing the pump efficiency and intake of water while increasing the pumping head and the pumping cost.

A common accepted industry standard for removing debris from water wells is the "swab and airlift technique," in which agitation is achieved through the vertical movement of a swab tool making a plunging action, with airlifting accomplished by using compressed air to remove the debris from the well. However, the airlifting action requires 100-200 feet of airline submergence below the well's static water level and does not provide a continuous flow (i.e., a constant flow velocity). Swab and airlift techniques also have physical limitations: their flow velocities are less controlled and their water movement is not continuous. Mechanical limitations of the swab and airlift technique include the maximum number of strokes applied within the developed zone (i.e., agitation). The swab tool and airline are affixed to the pump rig's mast, allowing 20-30 strokes within a 5-foot zone per minute. Areas of the well structures that lack the necessary submergence and/or have low-yielding aquifers may be limited to redevelopment with the swab and airlift technique. These factors may lead to increased costs and unsatisfactory results (i.e., high sand/sediment production and low flow rates).

Companies have attempted to develop various methods for cleaning plugged openings though various remedial operations such as chemical treatments, mechanical techniques (e.g., brushing and bailing), use of a high-pressure air gun to create a hydraulic wave, the use of jetted streams of liquid, reperforation of the casing, and so forth. However, most such cleaning methods are ineffective. Accordingly, there is a need to develop a method or system that improves on existing methods while solving such problems.

It is therefore an objective of the present invention to provide a well case brushing and surge blocking apparatus to improve upon the conventional well cleaning methods while incorporating other problem-solving features. The present invention is a mechanical structure and/or system with a rotating arm and may provide about 120 feet per minute with a 5 feet tool and a 6 feet stroke. A cleaning tool that is looped through the present invention is lowered to the well screen area once the initial debris is removed. The rotating arm action of the present invention can force volumes of water at high velocity through the screen area and into the well face, removing extra drill mud, sand, and chemical residue to dramatically increase the well's output. As a result, the present invention is able to improve upon the existing well cleaning method.

DETAIL DESCRIPTIONS OF THE INVENTION

Figure 1:
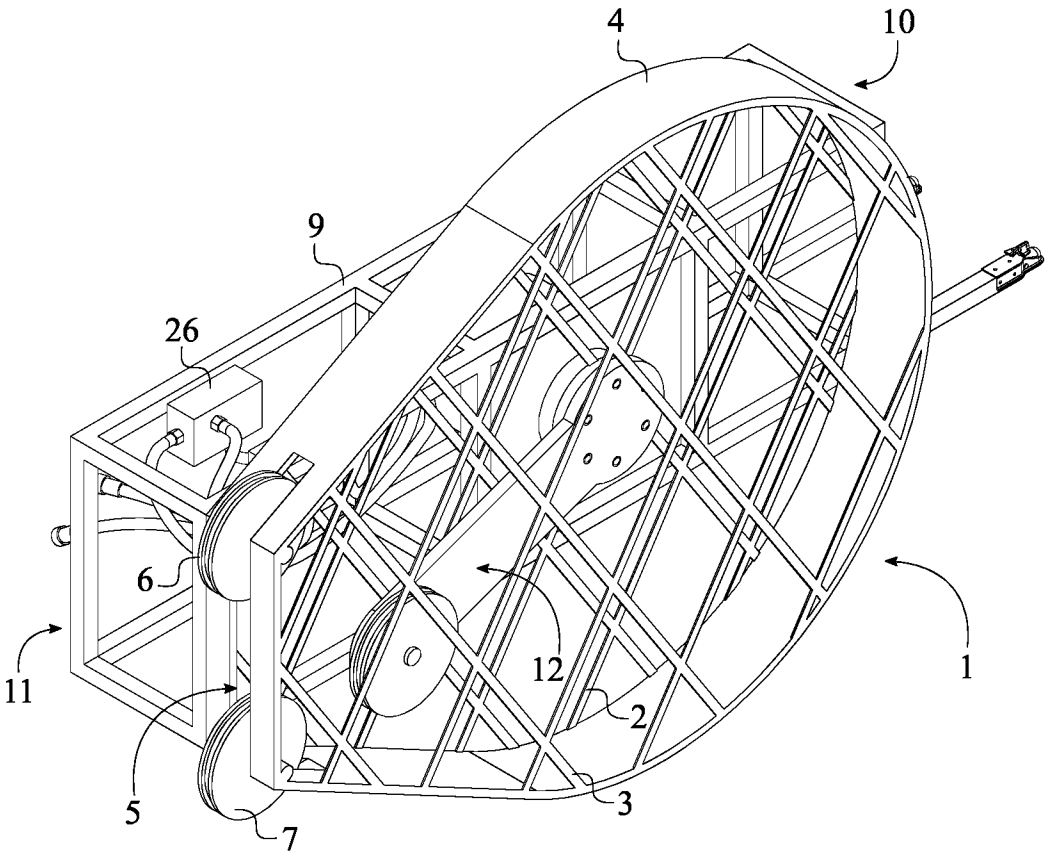
FIG. 1 is a perspective view of the present invention.

All illustrations of the drawings are for the purpose of describing selected versions of the present invention and are not intended to limit the scope of the present invention.

The present invention is a well case brushing and surge blocking apparatus that is used to brush a well casing or surge well during a well remediation process. The rotating arm action can force volumes of water at high velocity through the screen area of the well thus removing extra drill mud, sand, and chemical residue through the well face (opening) of the well. Due to the component configuration, the present invention is able to achieve about 120 feet per minute with a 5-foot tool and a 6-foot stroke from the rotating arm. Depending upon different steps of the well remediation process, the 5-foot tool can be a cleaning tool or a surge blocking tool. Aforementioned result provides a greater improvement over traditional output of a swab tool and airline of the pump rig's mast that allowing 20-30 strokes within a 5-foot zone per minute.

The present invention comprises a housing 1, a frame 9, an actuating arm 12, a gear assembly 17, a hydraulic motor 18, a hydraulic speed controller 21, and a hydraulic counterbalance 26 as shown in FIG. 1-3, FIG. 8, and FIG. 10. In reference to the general configuration of the present invention, the housing 1 is laterally connected to the frame 9 so that the housing 1 can be mounted to the rig via the frame 9. The actuating arm 12 is positioned within the housing 1, wherein the housing 1 function as a protective casing for the actuating arm 12. The actuating arm 12 functions as the rotating arm so that the sand line of rig can be looped through the present invention. The gear assembly 17 is laterally mounted to the frame 9, opposite of the housing 1 to provide optimal gear ration between the actuating arm 12 and the hydraulic motor 18. More specifically, a stator 19 of the hydraulic motor 18 is externally mounted to the gear assembly 17 so that a rotor 20 of the hydraulic motor 18 and the actuating arm 12 are able to torsionally couple with each other via the gear assembly 17. The hydraulic speed controller 21 is mounted to the frame 9 to control the rotational speed of the hydraulic motor 18. The hydraulic counterbalance 26 is mounted to the frame 9 so that the surging speed of the present invention can be controlled without compromising the structural integrity of the present invention. The hydraulic motor 18 is in fluid communication with the hydraulic speed controller 21 and the hydraulic counterbalance 26 in order to power the present invention with a hydraulic pump system of the rig.

Figure 2:
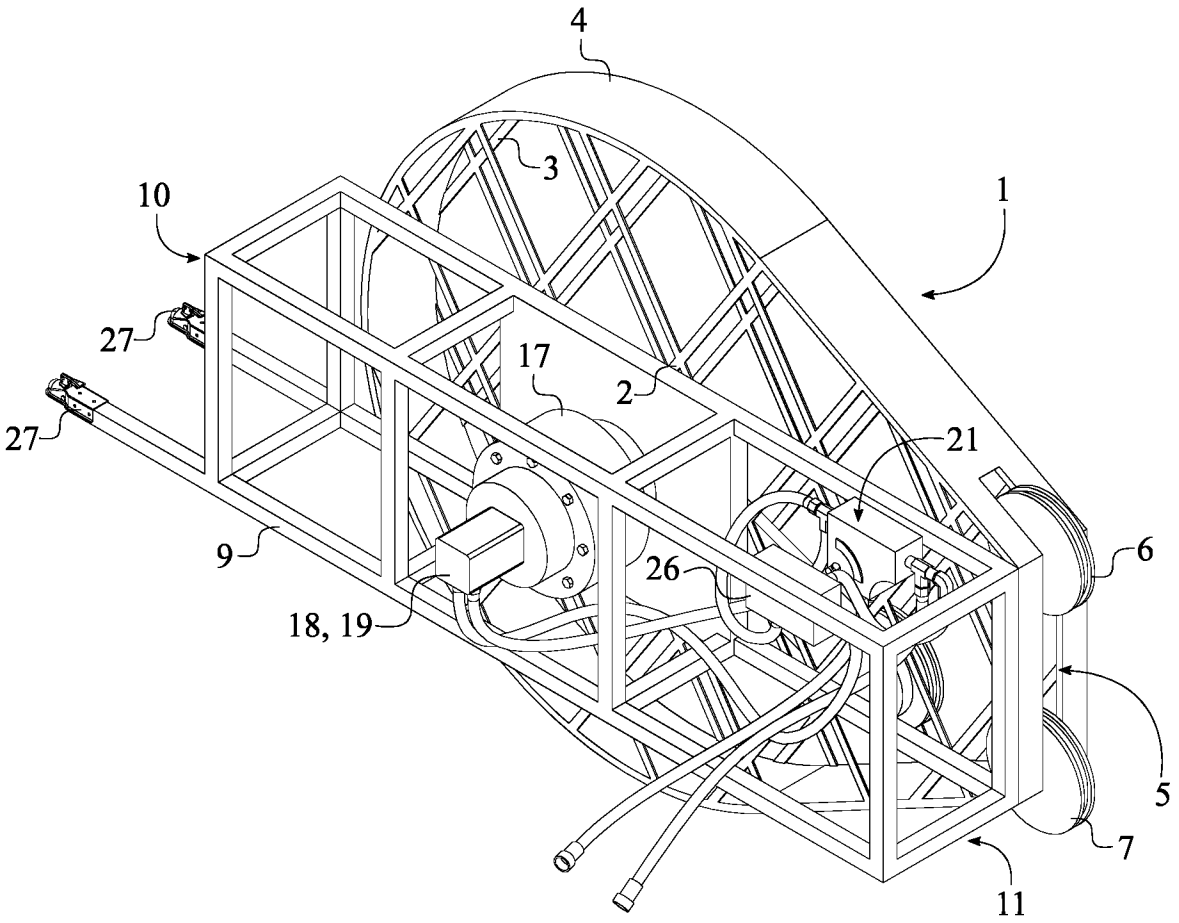
FIG. 2 is another perspective view of the present invention.
Figure 4:
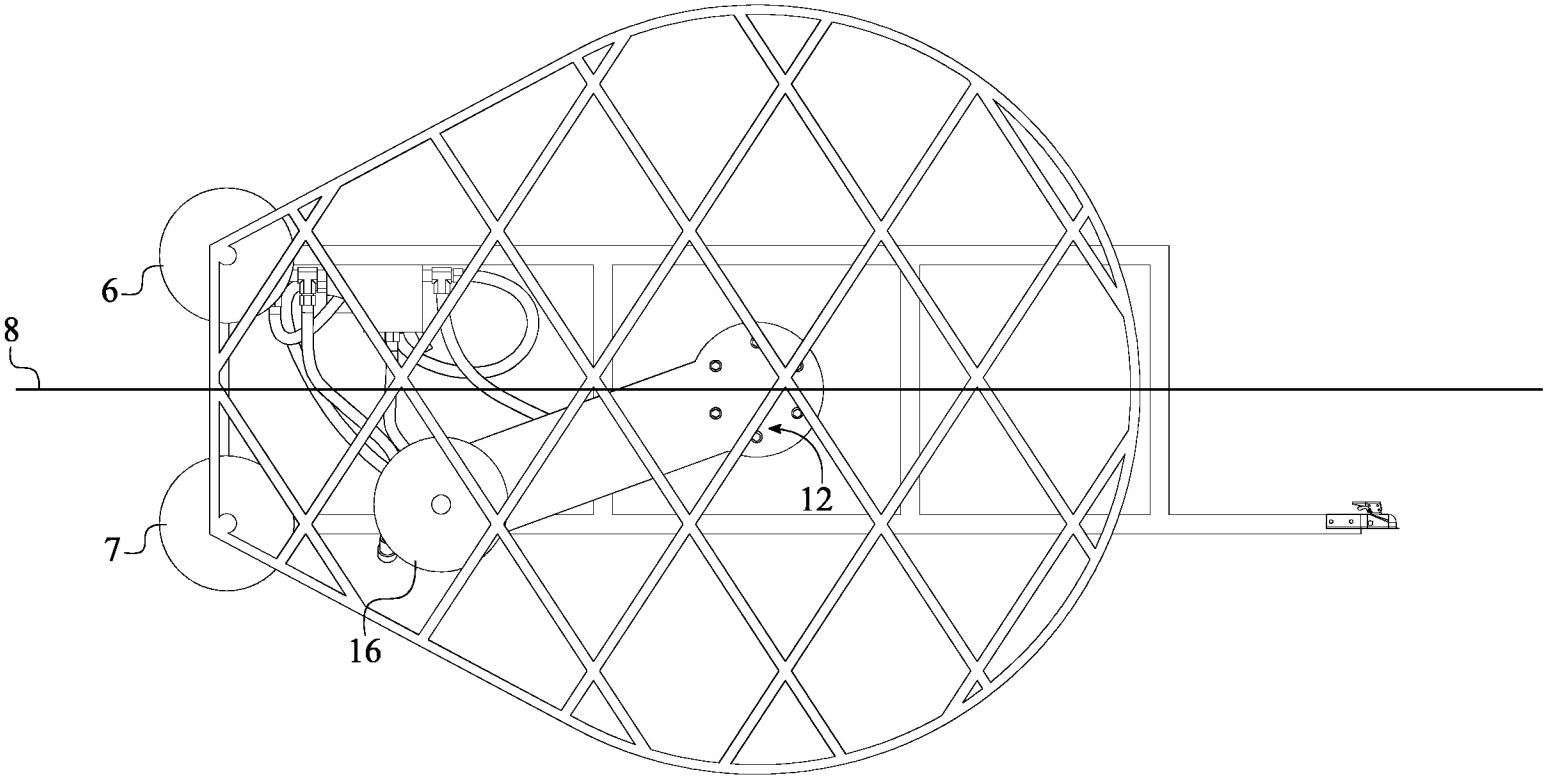
FIG. 4 is a side view of the present invention showing the transverse plane of the housing.

In reference to FIG. 1-2, the housing 1 that functions a protective casing for the actuating arm 12 comprises a first perforated panel 2, a second perforated panel 3, a lateral panel 4, a wire-rope opening 5, an upper sheave 6, and a lower sheave 7. More specifically, the first perforated panel 2 is perimetrically connected around the lateral panel 4. The second perforated panel 3 is perimetrically connected around the lateral panel 4, opposite of the first perforated panel 2. As a result, the first perforated panel 2, the second perforated panel 3, the lateral panel 4 are able to delineate a casing for the actuating arm 12. Preferably, the first perforated panel 2 and the second perforated panel 3 are made from expansion metal panels so that the rotation of the actuating arm 12 can be visible for inspection purposes. The wire-rope opening 5 centrally traverses into the housing 1 through the lateral panel 4 to provide an opening so that the sand line of rig can be engaged with the actuating arm 12. In order to minimize the friction between the sand line and the housing 1 during the operation of the present invention, the upper sheave 6 is rotatably connected to the lateral panel 4, and the lower sheave 7 is rotatably connected to the lateral panel 4. The upper sheave 6 and the lower sheave 7 are centrally positioned within the wire-rope opening 5 so that a rig end of the sand line can be engaged around the upper sheave 6, and a free end of the sand line can be engaged around the lower sheave 7. Furthermore, the upper sheave 6 is linearly positioned to the lower sheave 7 thus allowing the sand line to vertically moves in the upward direction and the downward direction. In other words, the upper sheave 6 and the lower sheave 7 are positioned perpendicular to a transverse plane 8 of the housing 1 as shown in FIG. 4.

Figure 3:
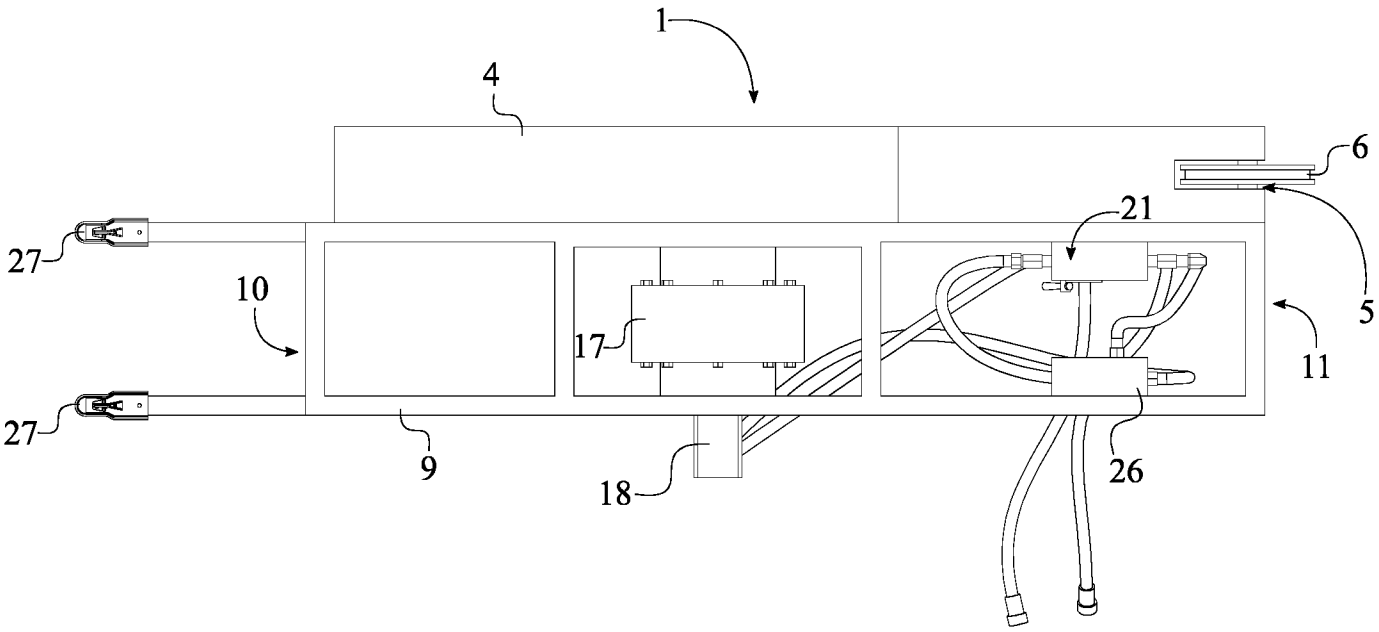
FIG. 3 is a top view of the present invention.

In reference to FIG. 1-3, the frame 9 is a structural body and functions as a platform thus allowing the rest of the components of the present invention to be secured. Preferably, the frame 9 is a skeletal structure and formed into rectangular shape so that the present invention can be outwardly hung from the back end of the rig. The first perforated panel 2 is adjacently connected to the frame 9 so that the housing 1 can be laterally connected to the frame 9. Furthermore, the upper sheave 6 and the lower sheave 7 are positioned adjacent to a free end 11 of the frame 9 so that the sand line can vertically moves in the upward direction and the downward direction, away from the back end of the rig.

In reference to FIG. 3, the present invention further comprises at least one trailer mount 27. The at least one trailer mount 27 is terminally connected to the frame 9 so that the frame 9 can be mounted to the back of the rig. More specifically, the at least one trailer mount 27 is positioned adjacent to a mounting end 10 of the frame 9 as the free end 11 and the mounting end 10 are positioned opposite of each other about the frame 9. The present invention preferably uses a pair of straight tongue trailer couplers as the at least one trailer mount 27. However, the at least one trailer mount 27 is not limited to the pair of straight tongue trailer couplers can be any other types of quick detaching coupling systems that can withstand the weight and movement of the present invention.

Figure 5:
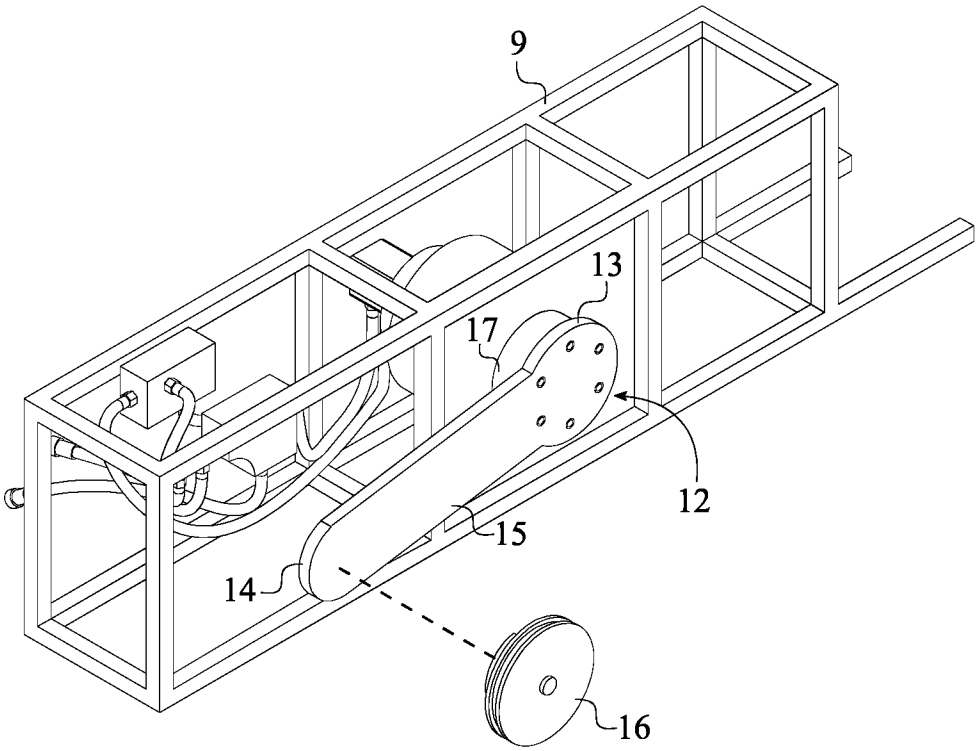
FIG. 5 is an exploded view of the middle sheave away from the distal section of the actuating arm.

The actuating arm 12 is configured to provide a specific vertical displacement of the tool (a cleaning tool or a surge blocking tool) that is attached to the free end of the sand line. In reference to FIG. 5, the actuating arm 12 comprises a proximal section 13, a distal section 14, an elongated section 15, and a middle sheave 16. The proximal section 13 is terminally connected to the elongated section 15 delineating an end of the actuating arm 12. The distal section 14 is terminally connected to the elongated section 15, opposite of the proximal section 13, delineating an opposite end of the actuating arm 12. The proximal section 13 is torsionally engaged with the gear assembly 17 so that the rotational force of the hydraulic motor 18 can be transferred into the actuating arm 12. When the hydraulic motor 18 is powered through the hydraulic pump system, the stator 19 of the hydraulic motor 18 rotates an input gear/shaft of the gear assembly 17 thus allowing the actuating arm 12 to be rotated about a first rotational axis of an output gear/shaft of the gear assembly 17. The middle sheave 16 is rotatably mounted to the distal section 14 as the upper sheave 6, the lower sheave 7, and the middle sheave 16 are positioned coplanar to each other. More specifically, the middle sheave 16 rotates about the first rotational axis due to the radial movement of the actuating arm 12 and also about a second rotational axis that concentrically traverses through the middle sheave 16. The middle sheave 16 provides a radial surface area so that the sand line can be looped around the middle sheave 16.

Figure 6:
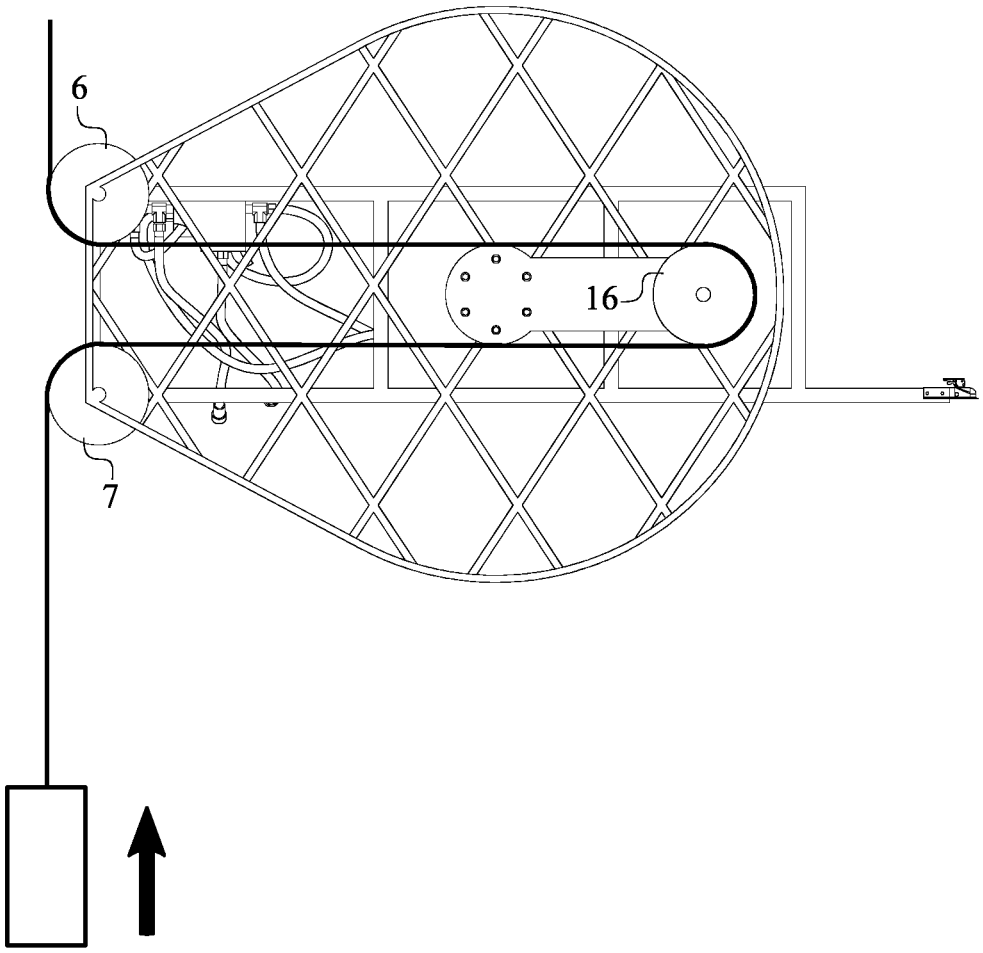
FIG. 6 is a side view of the present invention showing the upward vertical movement of the sand line with respect to the upper sheave, the lower sheave, and the middle sheave.
Figure 7:
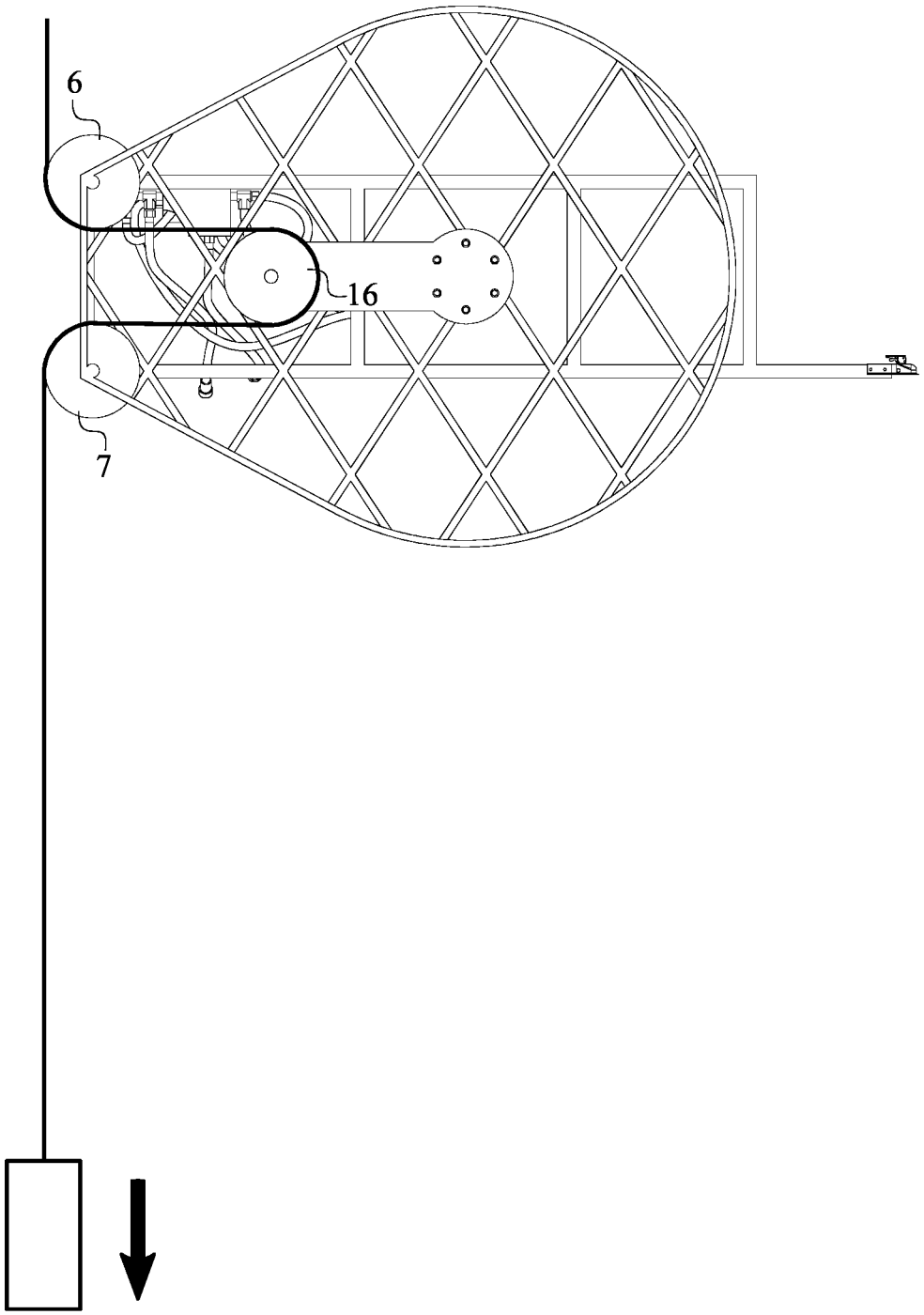
FIG. 7 is a side view of the present invention showing the downward vertical movement of the sand line with respect to the upper sheave, the lower sheave, and the middle sheave.
Figure 8:
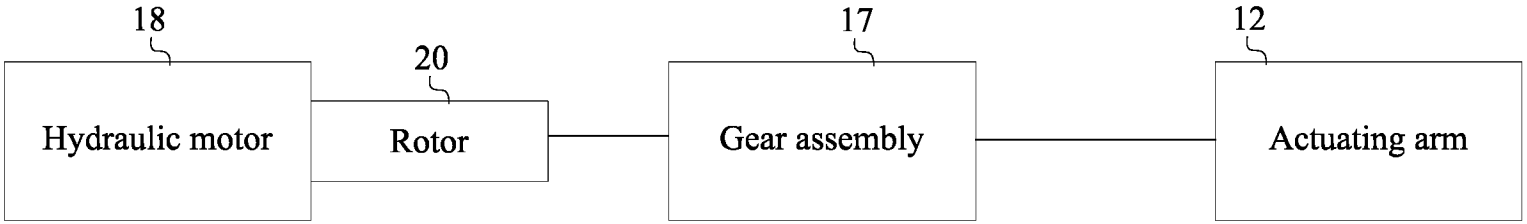
FIG. 8 is a schematic view showing the connection between the rotor of the hydraulic motor and the actuating arm through the gear assembly.

In reference to the engagement of the sand line with the present invention, the free end of the sand line is first engaged around the upper sheave 6 and inserted into the housing 1 so that the free end of the sand line can be looped around the middle shave. Then, the free end of the sand line is engaged around the lower sheave 7 and placed outside of the housing 1. The tool (a cleaning tool or a surge blocking tool) can then be attached to the free end of the sand line. In order to attain the specific vertical displacement of the tool, the rig end of the sand line maintains a stationary position with respect to the rig. When the actuating arm 12 rotates about the first rotational axis, the sand line that is looped around the middle sheave 16 radially travels around the first rotational axis also. As a result, the free end of the sand line vertically moves upwards and downward thus providing the specific vertical displacement for the tool. For example, as shown in FIG. 7, when the middle shave is positioned adjacent to the upper sheave 6 and the lower sheave 7 or the free end 11 of the frame 9, the tool is positioned at a maximum depth of the vertical displacement as a shorter section of the sand line is looped around the middle sheave 16. When the middle shave is positioned adjacent to the mounting end 10 of the frame 9, as shown in FIG. 6, the tool is positioned at a minimum depth of the vertical displacement as a larger section of the sand line is looped around the middle sheave 16.

Figure 9:
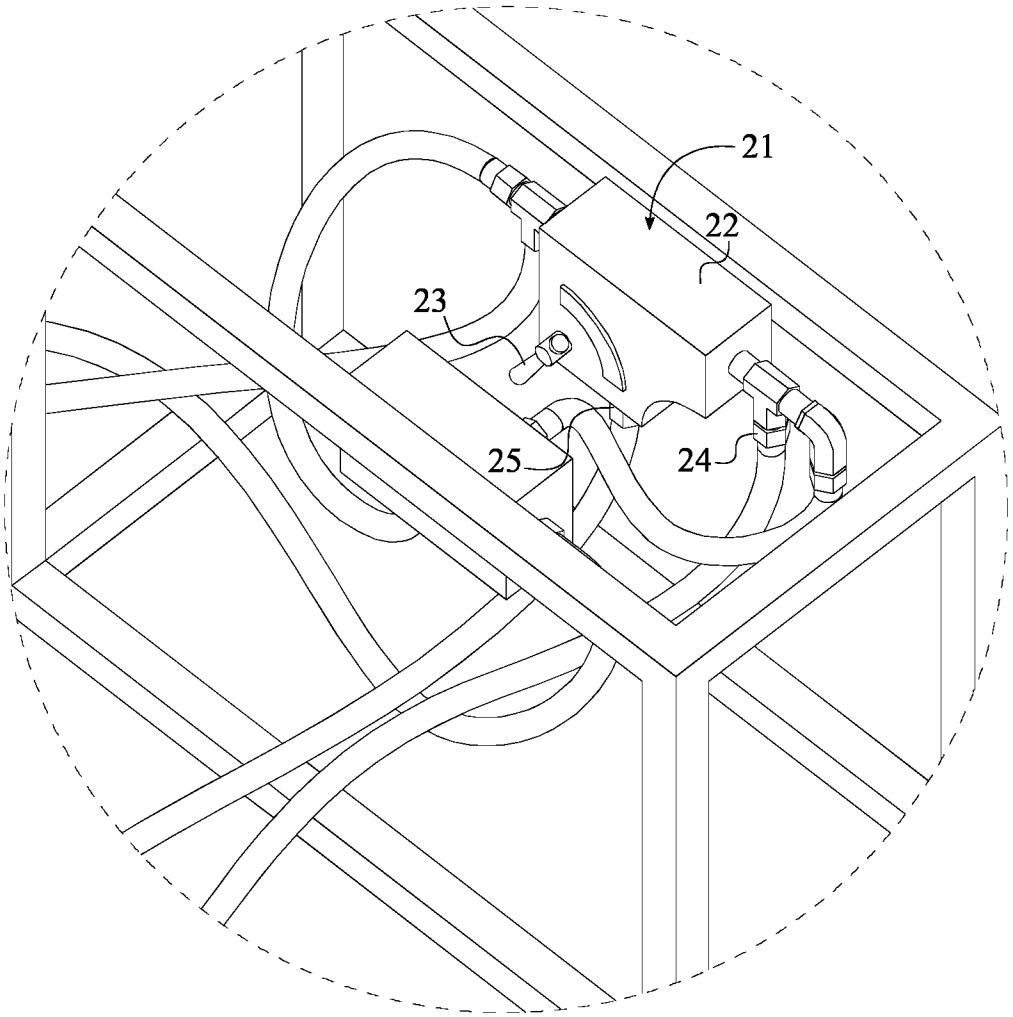
FIG. 9 is a detailed view showing the speed controller of the present invention.
Figure 10:
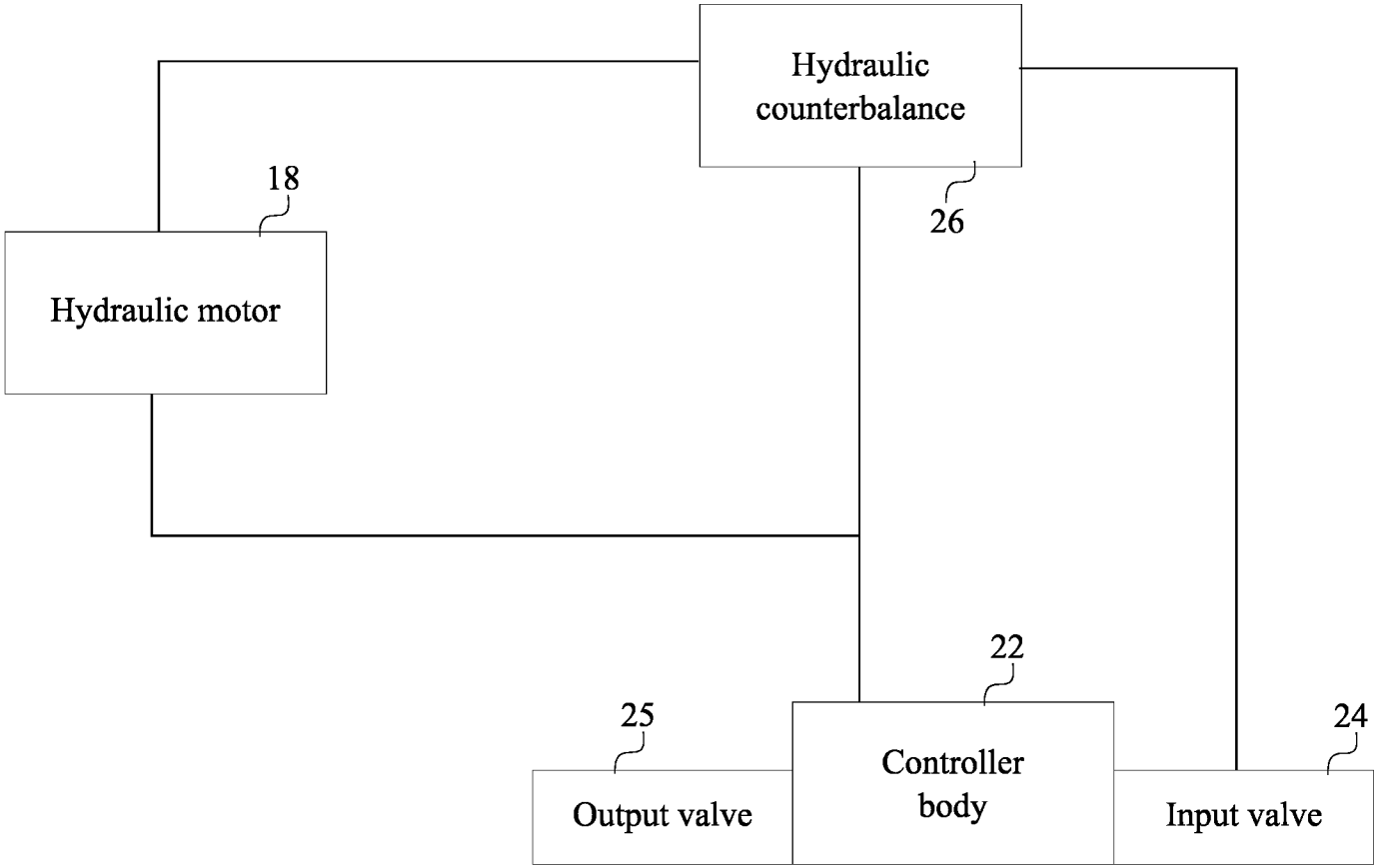
FIG. 10 is a schematic view showing the in fluid communication of the present invention.

In reference to FIG. 9, the hydraulic speed controller 21 comprises a controller body 22, a regulator handle 23, an inlet valve 24, and an outlet valve 25. The controller body 22 is mounted to the frame 9 and easily accessible to the user for repairs and maintenance. The regulator handle 23 is integrated into the controller body 22 as the rotational speed of the hydraulic motor 18 is controlled through the regulator handle 23. The inlet valve 24 is integrated into the controller body 22 so that a supply line of the hydraulic pump system can be in fluid communication with the present invention. As a result, a pressured hydraulic flow from the hydraulic pump system can be discharged into the controller body 22 via the inlet valve 24. The outlet valve 25 is integrated into the controller body 22 so that a return line of the hydraulic pump system can be in fluid communication with the present invention. As a result, a non-pressured hydraulic flow from the controller body 22 can be discharged into the hydraulic pump system via the outlet valve 25.

The hydraulic counterbalance 26 is utilized within the present invention to safely hold suspended loads and deal with over-running loads. As a result, the present invention is able to maintain constant velocity for the upward direction and the downward direction of the sand line and the tool. The hydraulic counterbalance 26 is positioned adjacent to the hydraulic speed controller 21. Furthermore, the hydraulic counterbalance 26 is mounted to the frame 9 and easily accessible to the user for repairs and maintenance.

The present invention can further comprise a secondary securing mechanism that provides additional protection for the attachment between the rig and the frame 9. More specifically, the secondary securing mechanism functions as a backup mounting system for the present invention to compensate any random failures of the at least one trailer mount 27.

As the first step of the well remediation process, all possible correspondence regarding the well, including the well log, maintenance records, and records of previous testing (e.g., e-logs, spinner tests) are collected by the operator.

As the second step, all equipment of the well is removed and each piece of equipment is then evaluated for wear and tear by the operator.

After the inspection of the equipment, a first video log is conducted as the third step via an underwater camera. During the first video log, operator records the well depth, evaluates the casing for any damage, including holes, ruptured welds, and additional pieces of equipment abandoned from prior work. If additional equipment or any other debris is found in the well, it should be removed to complete the third step.

As the fourth step, entire well casing and screen interval are brushed through the present invention. Optionally, the operator can also perform another video log via the underwater camera to inspect holes in the well casing after the fourth step is completed. The actuating arm 12 of present invention can force volumes of water at high velocity through the screen area and into the well face, removing extra drill mud, sand, and chemical residue to dramatically increase the output of the well.

As the fifth step, the operator performs a first pass of a submersible pump so that the well casing can be prepped for chemical injection. The submersible pump is much more efficient rather than traditional an air compressor to produce high-velocity controlled water flow to get any loose materials out from behind the screen interval to better assure the displacing of the chemicals on injection. For example, the submersible pump constant flow velocities can range from 350 to 750 gallons per minute (gpm), compared with the conventional swab and airlift technique's maximum rate of 300 gpm. A variable-frequency drive (VFD) can be used to maintain water levels and control flow velocities of the well structure being developed regardless of the well's condition. If flow velocities exceed the aquifer's yield, a loss of suction feature shuts the pump off, terminating the flow velocity, allowing the operator to adjust the flow and protect the well structure being developed.

As the sixth step, various types of chemicals are injected into the well casing. If an overabundance of driller's mud was used to set the well face before the casing was installed, special liquid clay dispersants can be used to break down and thin the driller's mud. Living and dead bacteria can attach to the casing, screen areas, and well face, reducing and sometimes even stopping the flow of water into the well. Special NSF (National Sanitation Foundation) approved chemicals can be used to kill the bacteria and dislodge the calcium carbonate from the different well surfaces.

As the seventh step, the present invention is utilized to surge block of chemical at a rate of 12 strokes per minute with a six foot stroke and ten foot surge blocking tool.

As the eighth step, chemical extraction is completed through the submersible pump in such a way that the pumping is completed at a rate of no less than 200 gallons per minute (well permitted on flow rate) until PH level is above 6.5.

As the ninth step, mechanical development is completed through the submersible pump in such a way that the pumping is completed at a rate of no less than 200 gallons per minute (well permitted on flow rate) through entire well screen until turbidity levels are less than 2 parts per million (PPM).

As the tenth step, well sump clean out with check valve is installed above the submersible pump, preventing the disturbed water column from reentering the well casing (i.e., at a loss of suction feature). In appropriate conditions, the operator may remove the check valve, allowing the water column to reenter the well structure, providing a focused surging action for the area being developed.

In reference to steps 8-10, in one embodiment, the submersible pump can be placed above an adjustable length of a stinger, where the stinger is a smaller-diameter pipe with the swab tool affixed to the bottom. The adjustable length of the stinger may be dependent on the total dynamic head of the submersible pump. This removes the limitations of the submergence requirement while providing controlled flow velocities with minimal submergence. Thus, the submersible pump can be used to improve and accelerate debris or residue removal.

In reference to the eighth step through the tenth step, in one embodiment, the submersible pump can be lowered near the debris level and a pipe extended from the bottom of the pump to suck up the debris much more rapidly, saving time and reducing costs. The constant flow velocity can be used in a controlled manner, allowing flow rates to be dialed in for any condition (e.g., low-yielding aquifers). The benefit of the submersible pump is that it provides the vacuum-tight seal needed to create positive suction that displaces the development water through the swab tool with high-velocity constant flow.

As the eleventh step, pump development is performed through pumping and surging to conduct the step test, constant flow rate test, and a post rehabilitation video log. The post rehabilitation video log is performed to identify any changes and inspect repairs made.

As the twelfth step, the present invention is utilized to perform a well disinfection by surge blocking sodium hypochlorite throughout entire wetted well casing.

As the thirteenth step, the operator conducts an updating process to provide all updating of the initial, including any new equipment if required. All equipment is then set back into the well.

Although the invention has been explained in relation to its preferred embodiment, it is to be understood that many other possible modifications and variations can be made without departing from the spirit and scope of the invention as hereinafter claimed.

What is claimed is:

1. A well case brushing and surge blocking apparatus comprising:

a housing;

a frame;

an actuating arm;

a gear assembly;

a hydraulic motor;

a hydraulic speed controller;

a hydraulic counterbalance;

the housing being laterally connected to the frame;

the actuating arm being positioned within the housing;

the gear assembly being laterally mounted to the frame, opposite of the housing;

a stator of the hydraulic motor being externally mounted to the gear assembly;

a rotor of the hydraulic motor and the actuating arm being torsionally coupled with each other through the gear assembly;

the hydraulic speed controller being mounted to the frame;

the hydraulic counterbalance being mounted to the frame; and the hydraulic motor being in fluid communication with the hydraulic speed controller and the hydraulic counterbalance.

2. The well case brushing and surge blocking apparatus as claimed in claim 1 comprising:

the housing comprising a first perforated panel, a second perforated panel, a lateral panel, a wire-rope opening, an upper sheave, and a lower sheave;

the first perforated panel being perimetrically connected around the lateral panel;

the second perforated panel being perimetrically connected around the lateral panel, opposite of the first perforated panel;

the wire-rope opening centrally traversing into the housing through the lateral panel;

the upper sheave being linearly positioned to the lower sheave;

the upper sheave and the lower sheave being positioned within the wire-rope opening;

the upper sheave being rotatably connected to the lateral panel; and the lower sheave being rotatably connected to the lateral panel.

3. The well case brushing and surge blocking apparatus as claimed in claim 2, wherein the upper sheave and the lower sheave being positioned perpendicular to a transverse plane of the housing.

4. The well case brushing and surge blocking apparatus as claimed in claim 2, wherein the first perforated panel being adjacently connected to the frame.

5. The well case brushing and surge blocking apparatus as claimed in claim 1, wherein the upper sheave and the lower sheave are positioned adjacent to a free end of the frame.

6. The well case brushing and surge blocking apparatus as claimed in claim 1 comprising:

the actuating arm comprising a proximal section, a distal section, an elongated section, and a middle sheave;

the proximal section being terminally connected to the elongated section;

the distal section being terminally connected to the elongated section, opposite of the proximal section;

the proximal section being torsionally engaged with the gear assembly; and the middle sheave being rotatably mounted to the distal section.

7. The well case brushing and surge blocking apparatus as claimed in claim 1 comprising:

the housing comprising an upper sheave and a lower sheave;

the actuating arm comprising a middle sheave; and the upper sheave, the lower sheave, and the middle sheave being positioned coplanar to each other.

8. The well case brushing and surge blocking apparatus as claimed in claim 1 comprising:

the hydraulic speed controller comprising a controller body, a regulator handle, an inlet valve, and an outlet valve;

the regulator handle being integrated into the controller body;

the inlet valve being integrated into the controller body; and the outlet valve being integrated into the controller body.

9. The well case brushing and surge blocking apparatus as claimed in claim 1 comprising:

at least one trailer mount;

the at least one trailer mount being terminally connected to the frame; and the at least one trailer mount being positioned adjacent to a mounting end of the frame.

* * * * *